United States Patent [19]

Oldham et al.

[11] Patent Number: 4,618,341

[45] Date of Patent: Oct. 21, 1986

[54] TUBE POSITIONING AND TRANSFER SYSTEM

[75] Inventors: Steve A. Oldham, Sandy; Ronald T. Picotte, Murray, both of Utah

[73] Assignee: Champion International Corporation, Stamford, Conn.

[21] Appl. No.: 659,707

[22] Filed: Oct. 11, 1984

[51] Int. Cl.[4] ..... B31B 1/00

[52] U.S. Cl. ..... 493/14; 198/347; 198/403; 198/414; 493/28; 493/260

[58] Field of Search ..... 493/10, 14, 18, 27, 493/28, 29, 30, 35, 214, 255, 260, 308; 414/736; 198/347, 358, 403, 414

[56] References Cited

U.S. PATENT DOCUMENTS

| | | | |
|---|---|---|---|
| 2,000,292 | 5/1935 | Miller | 198/403 |
| 3,566,754 | 3/1971 | Stork | 493/260 |
| 3,669,241 | 6/1972 | Chalich | 198/347 |
| 4,036,115 | 7/1977 | Hatch | 493/260 |
| 4,339,025 | 7/1982 | McCombie | 198/347 |
| 4,491,214 | 1/1985 | Malivoir et al. | 198/414 |

*Primary Examiner*—Lowell A. Larson
*Assistant Examiner*—Robert Showalter
*Attorney, Agent, or Firm*—Silverman, Cass, Singer & Winburn, Ltd.

[57] ABSTRACT

A tube transfer system wherein a hand of tubes is delivered to ender devices in any of four orientations, the system including a by-pass section for receiving hands when the ender devices are unable to accept tubes. The by-pass section is reversed to deliver by-passed hands to the ender devices when newly formed hands are not delivered to the system.

14 Claims, 7 Drawing Figures

TUBE POSITIONING AND TRANSFER SYSTEM

BACKGROUND OF THE INVENTION

1. Field of the Invention

The present invention relates to a system for positioning and transferring tubes, and more particularly to a method and apparatus for orienting for further processing unended multiwall paper tubes from which shipping sacks are formed.

According to the system, unended tubes formed in a tuber are stacked into hands and delivered lengthwise to a position adjacent the entry section of bottomer or ender equipment which receives the hands sidewise and closes and seals one end of each tube. Since customer requirements vary, some requiring the tubes to be ended flap-to-face at one end or at the opposite end, or flap-to-back at one end or at the opposite end, the tubes must be oriented for proper entry into an ender based upon those requirements. Thus, the present system contemplates positioning the tubes for entry into the ender in one of four dispositions, that is, with one side or the other (the topside or the bottom side) facing upwardly and, in either case, with one end or the other facing a given direction relative to the ender.

Since a tuber may produce tubes at a rate of the order of 210 per minute and an ender can end tubes at a rate of the order of 75 per minute, the system includes at least one and preferably two enders and a by-pass to provide optimum utilization of the enders. For example, if two enders are used and the first ender for any reason cannot accept tubes due to a backup or jam, the tubes are automatically transported to the second ender during normal production. If the second ender cannot accept tubes, excess tubes are fed automatically to the by-pass which feeds the excess tubes back to the enders when both are again in operation and no new tubes are being supplied by the tuber due, for example, to tuber failure or normal down time for a print roll change. Thus, the by-pass supplies excess tubes to the enders so that the enders remain in production while the tuber is down.

2. Description of the Prior Art

As flat lengths of paper move through a tuber to be formed into tubes, the surface of the inner layer is lubricated by moistening it with a spray of water to reduce friction between the paper and metal guides that fold the paper to form the tubes. Additionally, the lengthwise seam formed by the tuber is adhered with a water base adhesive and the several layers are spot glued together along the tube ends to prevent slippage of the individual layers relative to one another. In the past, the moisture from the spray and the adhesive was absorbed into the paper before the tubes could be bottomed or ended in the enders, because tubes were not delivered directly from the tuber to an ender and, in any case, any required reorientation of the tube hands was done manually. Such absorption often caused problems in the ending operation because the hot melt adhesive used to end the tubes would not adhere to paper in which moisture had been absorbed. Accordingly, the tubes had to be stored for a period of from 24 to 48 hours in a controlled atmosphere, or up to three days in an uncontrolled atmosphere to allow complete drying.

There is available a machine that inverts a hand of tubes about the longitudinal axis of the tubes but is unable to reverse the tubes end to end. This device is part of a flow through system from tuber to ender so that if any part of the system fails, the entire system must be taken out of production.

SUMMARY OF INVENTION

The present invention is directed to a system which overcomes the foregoing difficulties and disadvantages. Thus, according to the system, hands of tubes are rapidly oriented for ending as required by the customer and then fed into an ender before the moisture applied as a lubricant or in the water base adhesive, as mentioned above, has an opportunity to be absorbed into the paper of which the tubes are formed, thereby obviating the need to maintain inventory and atmosphere control facilities and reducing associated labor costs. Additionally, because of the by-pass feature of the invention, output of ended bags may be maintained during tuber down time.

In accordance with the invention, a tube transfer system is provided which includes a device for forming and stacking hands of tubes, first and second enders for closing one end of each tube, and a conveyor for transporting the hands of tubes from the forming and stacking device to the enders and including a by-pass section for transporting the hands of tubes beyond the enders. Sensing devices, such as photoelectric elements, are provided for determining or sensing when the enders cannot accept tubes. A control unit, responsive to the sensing devices, causes the hands of tubes to be transported into the second ender if the first ender cannot accept tubes or into the by-pass section if the second ender cannot accept tubes. The control unit, again responsive to the sensing devices, reverses the direction of transport of the by-pass section to transport the hands from the by-pass section to the enders when the enders can accept tubes and the system is not supplied with tubes from the forming and stacking device. Provisions are made for pushing the hands of tubes off the conveyor into the enders and for, when required, inverting and rotating the hands of tubes before passing them to the enders.

BRIEF DESCRIPTION OF THE DRAWINGS

Specific embodiments of the invention have been chosen for purposes of illustration and description, and are shown in the accompanying drawings, forming a part of the specification wherein.

DESCRIPTION OF THE PREFERRED EMBODIMENT

Figures 1, 2:
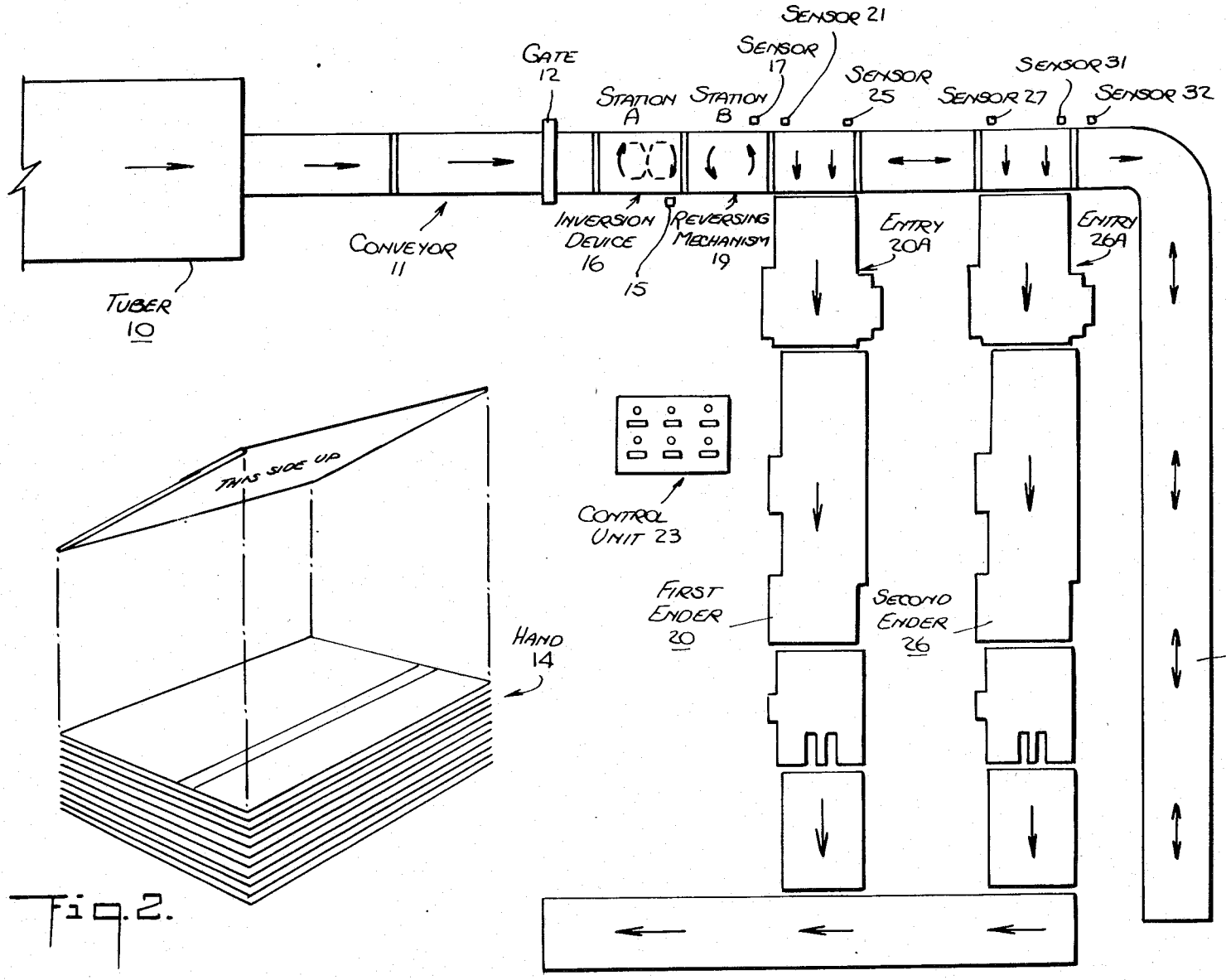
FIG. 1 is a schematic view, in plan, of a system according to the present invention.
FIG. 2 is a perspective view illustrating a hand of tubes with the uppermost tube tilted to reveal its underside.

Referring to FIG. 1, the numeral 10 designates a conventional tuber for forming multiwall tubes from elongate, superposed sheets of paper. The formed tubes are placed on a conveyor 11 in shingled disposition and advanced in the direction of the arrows to a gate 12 or hand forming means which stacks the tubes by interfering with their advance for a determined time period during which the shingled tubes slide along one another to abut against the gate, thus forming a stack or hand 14 of the desired number of tubes, say of the order of 25 tubes in the case of pinch bottom tubes, illustrated in FIG. 2.

Figure 3:
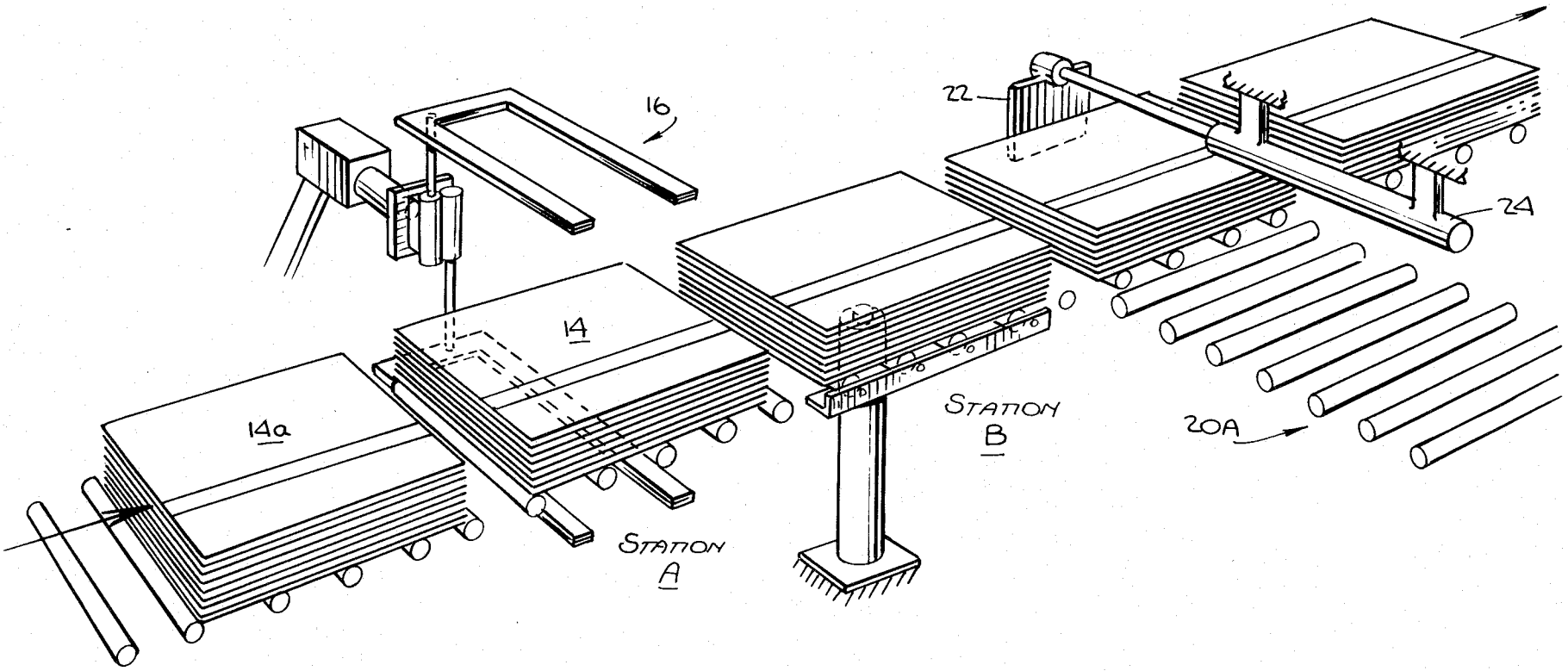
FIG. 3 is a perspective view of a portion of the system illustrating several hands of tubes one of which is prepared for inversion.
Figure 4:
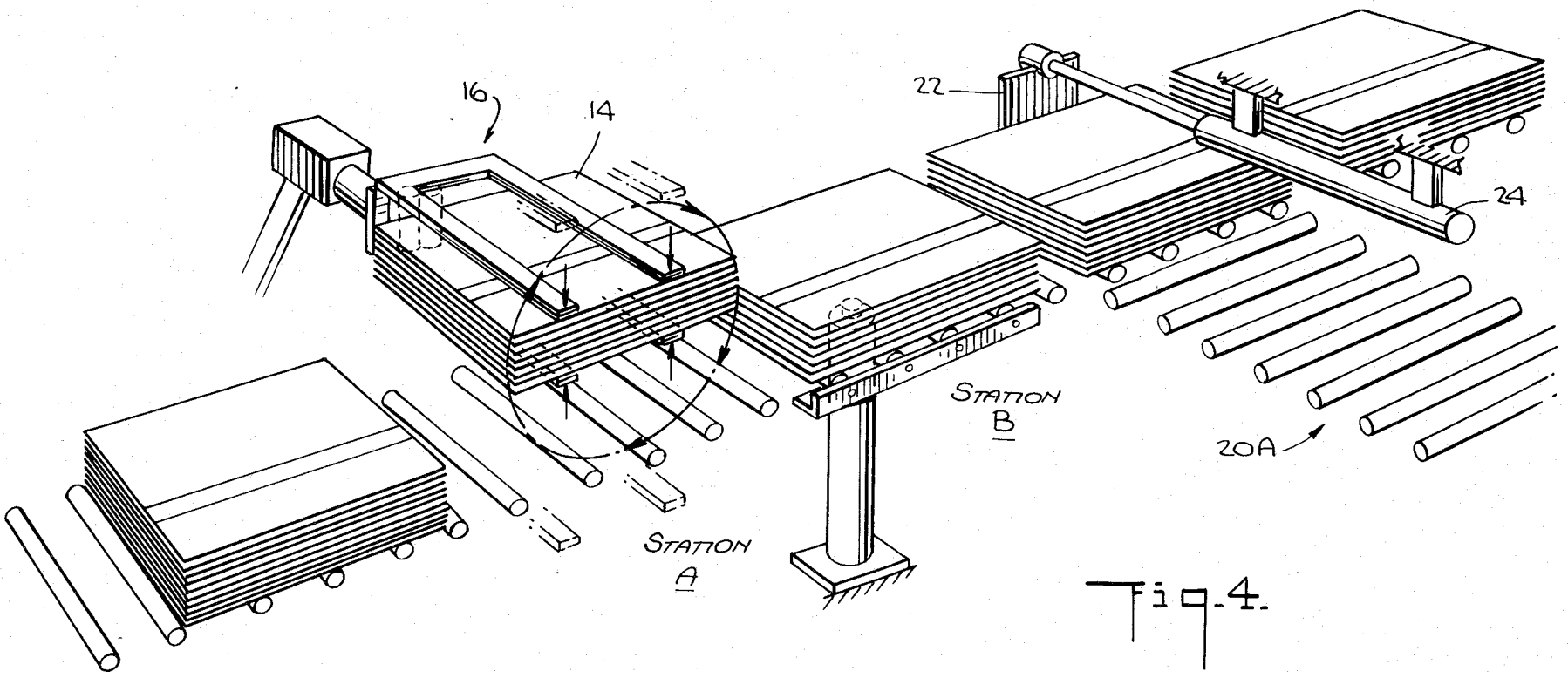
FIG. 4 is a view similar to FIG. 3 but illustrating the inversion operation.
Figure 5:
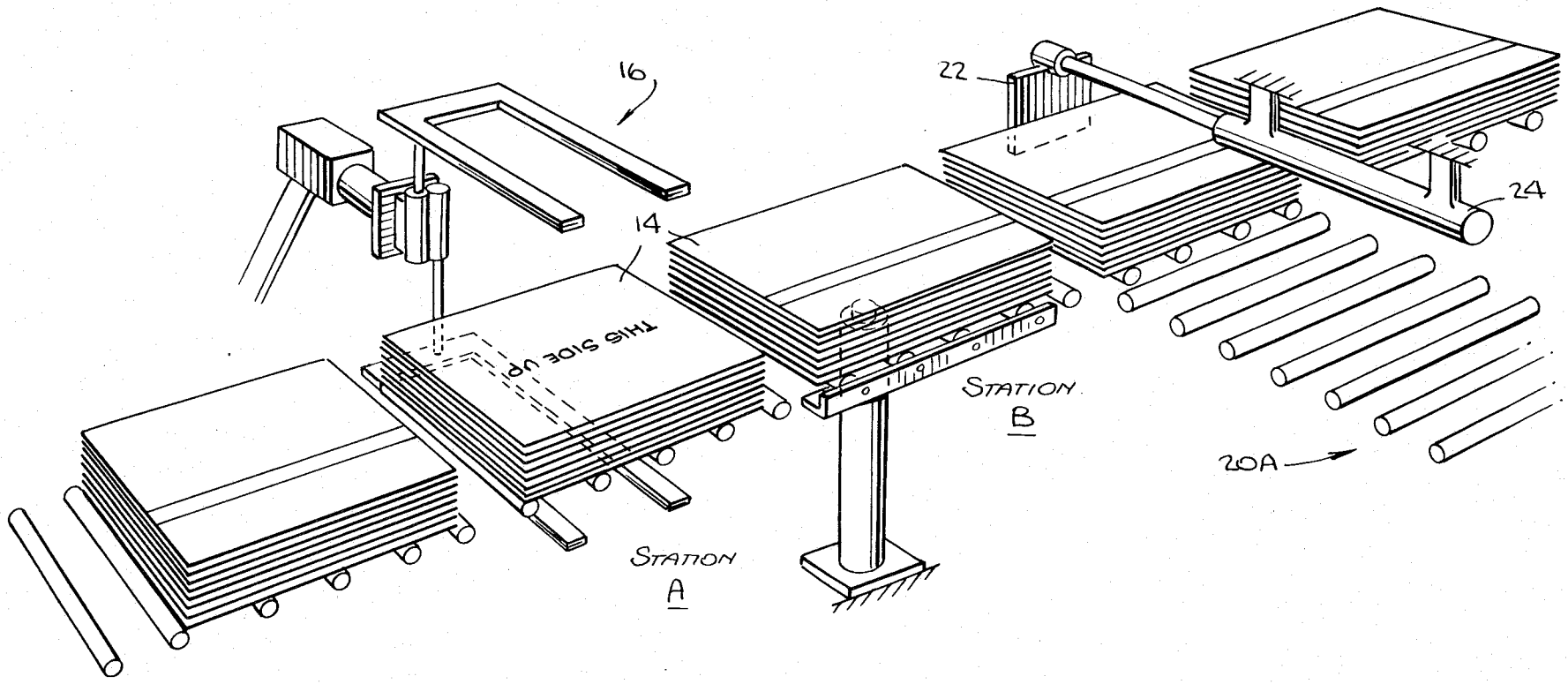
FIG. 5 is a view similar to FIGS. 3 and 4 illustrating a hand of tubes in inverted condition.
Figure 6:
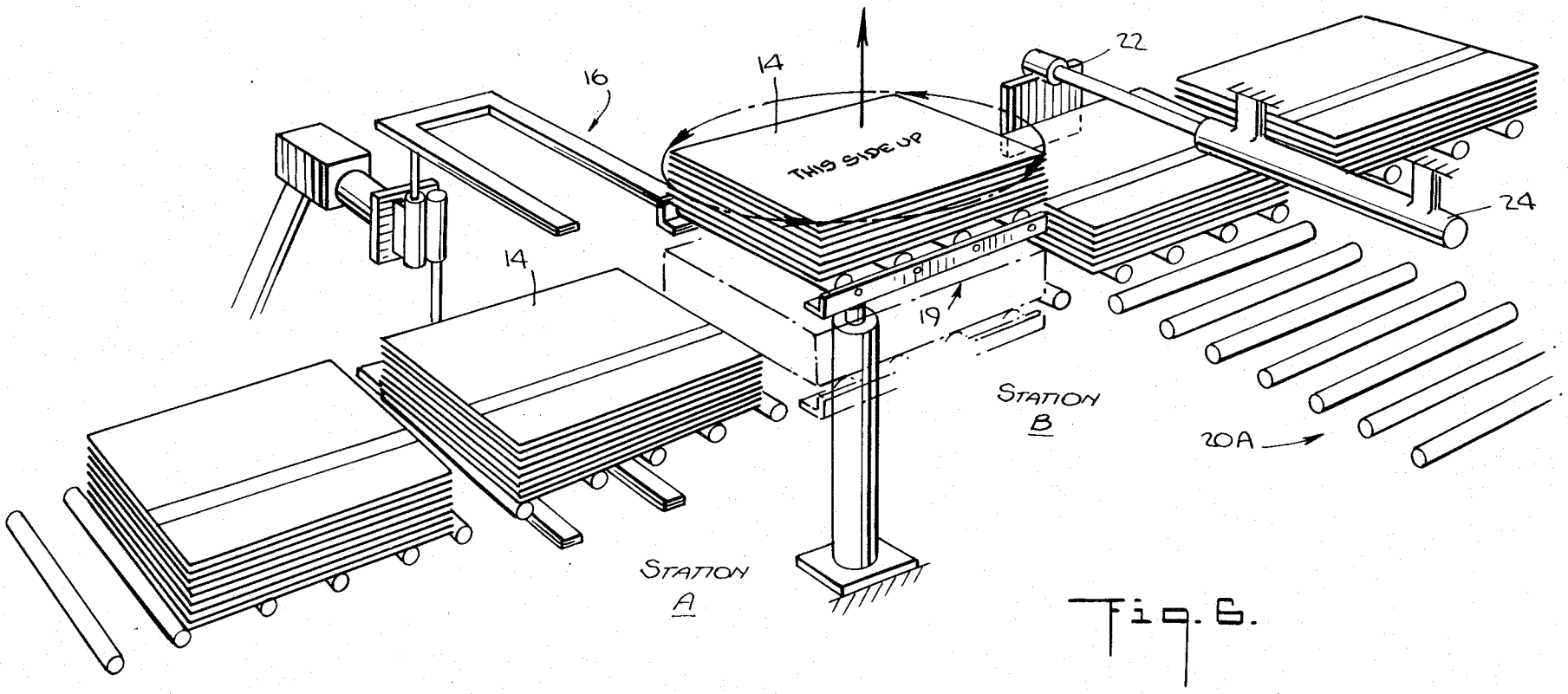
FIG. 6 illustrates the inverted hand of tubes between the inverting means and the ender means.

The gate 12, sometimes referred to as a tube counter, is associated with a known counting mechanism and sensing switch and the tuber includes a cutter which operates the counter which in turn operates the switch to open the gate to release the hand 14 when it is constituted by the desired number of tubes. When released, the hand advances to station A (FIGS. 1, 3 and 4) at which its presence is sensed by a photoelectric sensor 15, for example, which signals through conventional relays a control unit 23 which, in turns, stops that portion of the conveyor, and thus the hand, at station A. If customer requirements for the current production run necessitate inversion for reasons already mentioned, a suitable device indicated generally at 16, grasps the hand, lifts it from the conveyor, effectively rotates it 180° about a horizontal axis perpendicular to the direction of advance of the hand thus far on the conveyor and returns it to the conveyor where it remains at station A until the gate 12 opens to release another hand 14*a* (FIG. 3). Thus device 16 reverses or interchanges the positions of the ends and of the top and bottom sides of the hand. The release of hand 14*a* is sensed in any convenient way, as by a photoelectric sensor which acts through the control unit 23 to restart the conveyor at station A further to advance the hand 14 while the hand 14*a* approaches station A.

If the hand is not to be inverted, the procedure described thus far is the same except that the control unit 23 is programmed to refrain from operating the inverting device 16.

Figure 7:
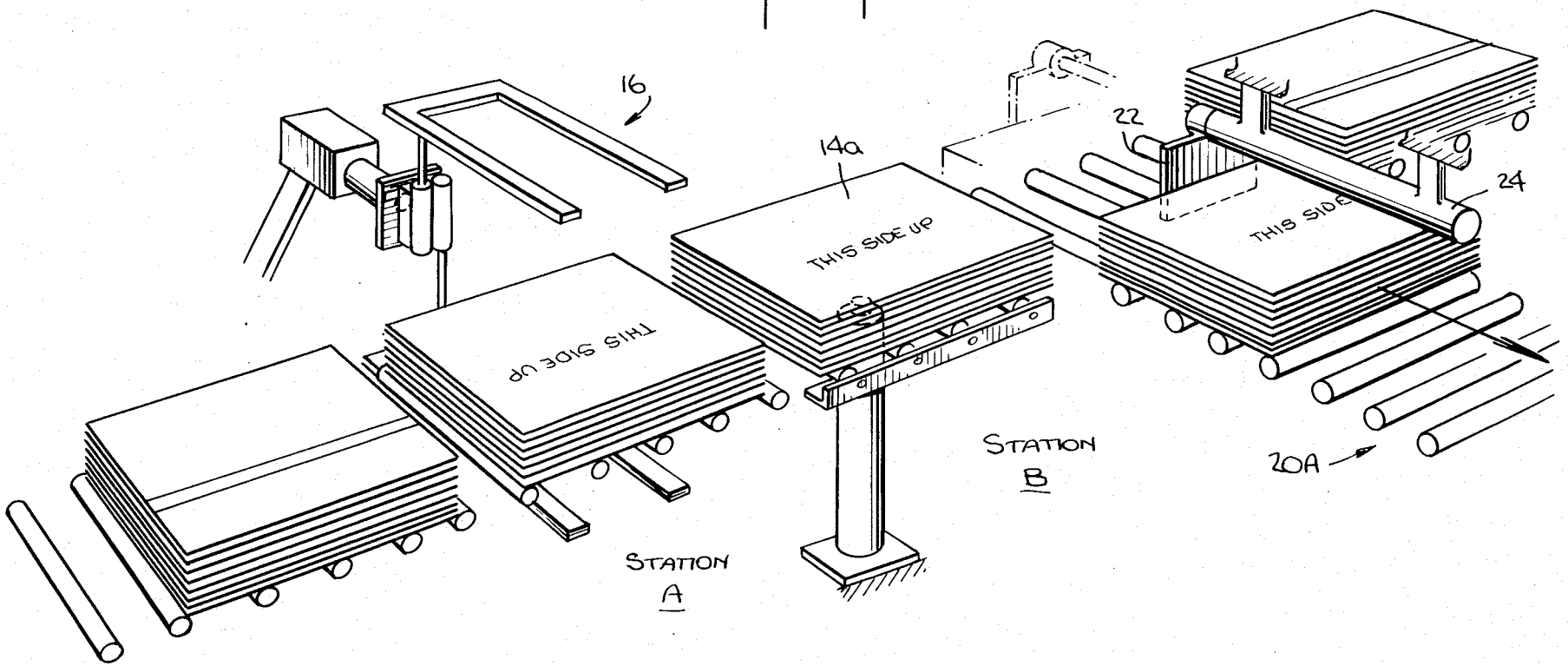
FIG. 7 illustrates the system with the inverted, rotated hand of tubes prepared for advance to the ender means and the next following hand inverted.

When the hand 14 reaches station B, its presence there is sensed by another sensor 17 (FIG. 1) which, through the control unit 23, stops that portion of the conveyor at station B. If customer requirements necessitate that the hand 14 at station B be reversed, a reversing mechanism 19 under the control of the control unit, lifts the hand from the conveyor and rotates it 180° about a vertical axis and replaces it on the conveyor. If the hand is not to be reversed, the reversing mechanism is not actuated. In either case, at expiration of the wait time, the conveyor is reactivated and the hand 14 is transported toward the entry section 20A of the first ender 20 where the conveyor at this point is stopped as the presence of the hand there is sensed by sensor 21 which, acting through the control unit, causes a fluid operated ram 24 to shift push plate 22 adjacent the conveyor to push the hand in a direction 90° to its previous direction of movement, that is, to the conveyor direction, into the entry section 20A of the first ender 20, as shown in FIG. 7, after which the ram returns the push plate to its starting position indicated in phantom in that Figure.

The next hand 14*a*, by this time, is approaching the first ender, but since the ender must peel the tubes from the hand to end them one at a time, there is a delay before the first ender is able to accept another hand. The presence of a portion of the hand 14 in the entry section of ender 20 is sensed by sensor 25 which, through the control unit, prevents that portion of the conveyor opposite the ender entry section 20A from stopping and also prevents actuation of the ram 24, and thus the push plate 22, when hand 14*a* reaches ender 20. Also, if the ender 20 is down for any reason, that fact is sensed and the control unit fails to stop the conveyor at its entry section and to operate the push plate 22. Thus, in either case, the hand 14*a* is transported past entry section 20A to entry section 26A of the second ender 26 where its presence is sensed by sensor 27 which, acting through the control unit, causes that portion of the conveyor 11 opposite the second ender to stop and activates a second push plate, not depicted, but similar to push plate 22, by means of a ram similar to ram 24, to push the hand 14*a* off the conveyor and into the entry section 26A of the second ender 26.

If the second ender cannot accept the hand 14 for any reason, such as the presence of a portion of a previous hand in its entry section or because that ender is shut down, that fact is sensed by sensor 31 which causes the control unit to maintain the conveyor at the second ender entry section operative and to refrain from activating the second push plate in which case the hand is transported into a by-pass section 30. In this connection, it will be recalled that the tuber 10 produces tubes at a rate greater than the rate at which the enders can accept them.

The by-pass section 30 is essentially an elongate, reversible conveyor which accumulates hands that are not pushed into the entry sections of the enders 20 and 26. When a hand begins to enter the by-pass section, a sensor 32 senses its presence and causes the control unit 23 to operate tube by-pass conveyor for a period of time of the order of 2 to 3 seconds until the hand is fully received and moved sufficiently along on the by-pass to allow for a predetermined spacing between adjacent hands.

If, for any reason, the tuber 10 is shut down, as for a print roll changeover, for example, that fact is sensed and the control unit causes the by-pass section to reverse its direction of transport so that the last hand to enter the by-pass section is delivered to the second ender 26 when the by-pass conveyor is reversed, that portion of conveyor 11 from the first ender 20 to the by-pass section is also reversed, the sensor 32 is deactivated and the sensors 27, 31, serving ender 26, and 21, 25, serving ender 20, operate in the reverse mode. Thus, if the ender 26 can accept a hand, that portion of the conveyor 11 opposite the ender is stopped and the hand is pushed into the ender entry section. If ender 26 cannot accept hand, the hand continues on to the ender 20 at which time the portion of the conveyor at its entry section is stopped and the hand is pushed into that entry section. This procedure continues until all hands in the by-pass section are fed to the enders or until normal feed from the tuber resumes.

Control unit 23 is a standard Allen Bradley industrial terminal Model 1770-TI which is programmable by the user to perform various desired functions, in selected sequence, through a series of relays responsive, in the present case, to the photoelectric sensors.

From the foregoing description, it will be seen that we contribute by the present invention, a tube positioning and transfer system by which we are able to orient the tubes for presentation for ending in any of the four dispositions mentioned, to feed the tubes for ending before the moisture applied thereto as a lubricant or in water base adhesive has an opportunity to be absorbed into the paper of which the tubes are formed, thus obviating the equipment and labor costs and time loss involved in controlled drying and to maintain output of ended bags during tuber down time.

We claim:

1. A tube transfer system of the class described comprising:

means for forming and stacking a hand of tubes;

first and second enders for closing and sealing one end of each tube;

conveyor means for transporting said hand of tubes from said forming and stacking means to said enders;

a by-pass section for transporting said hand beyond said enders, the second ender being disposed between said first ender and said by-pass section;

means for sensing when said first and second enders cannot accept tubes;

means responsive to said sensing means for causing the hand of tubes to be transported to said second ender when said first ender cannot accept tubes and to said by-pass section when said second ender cannot accept tubes; and means for reversing the direction of transport of said by-pass section when the system is not supplied with tubes from said means for forming and stacking a hand of tubes to transport the hand from said by-pass section to said second ender when said second ender can accept tubes and to said first ender when said second ender cannot accept tubes.

2. A tube transfer system according to claim 1 wherein said sensing means includes photoelectric detectors, and a control unit responds to and cooperates with the photoelectric detectors to control transportation of the hand of tubes relative to said enders and said by-pass section.

3. A tube transfer system according to claim 2 wherein said sensing means includes a detector to sense the entry of a hand of tubes into said by-pass section, and the control unit responds to and cooperates with the detector to cause said by-pass to operate for a period of time sufficient to receive the hand and to allow a predetermined spacing between the hand and the next succeeding hand to enter the by-pass section.

4. A tube transfer system according to claim 1, wherein push plates are provided to transfer the hand of tubes from the conveyor means into the first and second enders when a hand of tubes reaches a respective ender and the sensing means determines that the respective ender can accept the hand.

5. A tube transfer system according to claim 4, wherein the push plates are operable to push the hand of tubes 90° off the conveyor means and into the feeder section of the respective ender.

6. A tube transfer system according to claim 1, wherein means are disposed between said forming and stacking means and said first ender for inverting a hand of tubes by effectively rotating the hand 180° about a horizontal axis perpendicular to the direction of advance of the hand.

7. A tube transfer system according to claim 6, including means for continuing advance of the inverted hand of tubes in timed relation to release of a subsequent hand of tubes from said tube forming and stacking means.

8. A tube transfer system according to claim 6, wherein said sensing means includes photoelectric detectors, and a control unit responds to and cooperates with the detectors to control transportation of the hand of tubes relative to said enders and said by-pass section, to interrupt the advance of a hand of tubes at a position along said conveyor means adjacent said inverting means, and to cause said conveyor means to continue advance of an inverted hand toward said enders.

9. A tube transfer system according to claim 6 including means disposed upstream of said first ender for rotating the hand 180° about a vertical axis perpendicular to the direction of advance of the tubes.

10. A tube transfer system according to claim 9, wherein said sensing means includes photoelectric detectors, and a control unit responds to and cooperates with the detectors to control transportation of the hand of tubes relative to the enders and by-pass section, to interrupt the advance of the hand of tubes at a position along said conveyor means adjacent said rotating means, and to cause said conveyor means to continue advance of a rotated hand toward said enders.

11. A method of transferring unended tubes from tube forming and stacking means to first and second enders disposed substantially upstream of a by-pass section comprising:

advancing a hand of tubes formed by said forming and stacking means toward said enders;

feeding the hand of tubes into said first ender;

advancing the hand of tubes beyond said first ender to the second ender when the first ender cannot accept tubes and to the by-pass section if said second ender is unable to accept the hand when it arrives at said second ender;

sensing when the first and second enders cannot accept tubes and causing the hand of tubes to be transported to the second ender when the first ender cannot accept tubes and to the by-pass section when the second ender cannot accept tubes; and reversing the direction of transport of the tubes in said by-pass section when tubes are not supplied from the forming and stacking means to transport the hand from the by-pass section to said second ender when the second ender can accept the hand of tubes and to said first ender when said second ender cannot accept tubes.

12. A method according to claim 11, including:

inverting the hand of tubes, before feeding the hand into the first ender, by effectively rotating the hand 180° about a horizontal axis perpendicular to the direction of advance of the hand.

13. A method according to claim 12, including:

interrupting the advance of the hand of tubes at a predetermined position between the position at which the hand may be inverted and the first ender;

rotating the hand of tubes 180° about a vertical axis perpendicular to the direction of advance of the hand of tubes; and continuing advance of the rotated hand toward the first ender.

14. A method according to claim 11, including:

sensing entry of the hand of tubes into the by-pass section; and operating the by-pass section for a period of time sufficient to receive the hand and to allow a predetermined spacing between the hand and the next succeeding hand to enter the by-pass section.

* * * * *